United States Patent [19]

Piscetta

[11] Patent Number: 4,934,247

[45] Date of Patent: Jun. 19, 1990

[54] LOCKING ASSEMBLY FOR WEAPON BARRELS

[76] Inventor: Armando Piscetta, Via delle Fornaci No. 41, 17025 Loano (Savona), Italy

[21] Appl. No.: 347,512

[22] Filed: May 3, 1989

[30] Foreign Application Priority Data

May 4, 1988 [IT] Italy ..... 20439 A/88

[51] Int. Cl.[5] ..... F41A 5/04

[52] U.S. Cl. ..... 89/163

[58] Field of Search ..... 89/163, 196

[56] References Cited

PUBLICATIONS

Jorgensen et al., "Rear Lock-Up Stabilizes .45 Pistol", American Rifleman, vol. 117, No. 8, Sep. 1969, p. 41.

*Primary Examiner*—Stephen C. Bentley

*Attorney, Agent, or Firm*—Bucknam and Archer

[57] ABSTRACT

A locking assembly for weapon barrels comprises a slide including lugs removably engaging with grooves formed on the barrel which is associated with the weapon frame by means of a coupling rod in turn coupled to the weapon frame and barrel through coupling members suitable to cause the barrel to translate and turn for disengaging from the weapon frame.

4 Claims, 2 Drawing Sheets

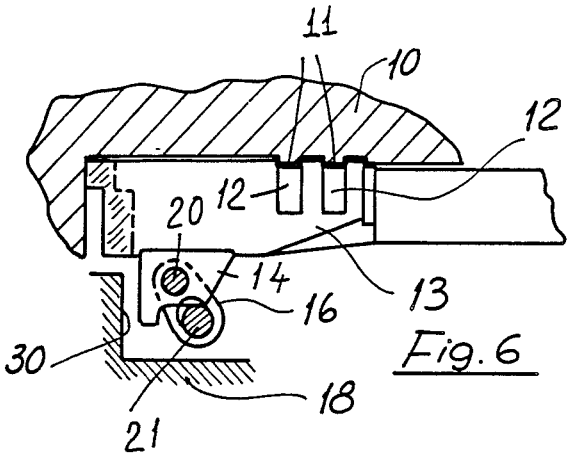
Fig. 6
Fig. 7
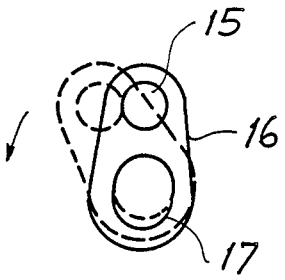
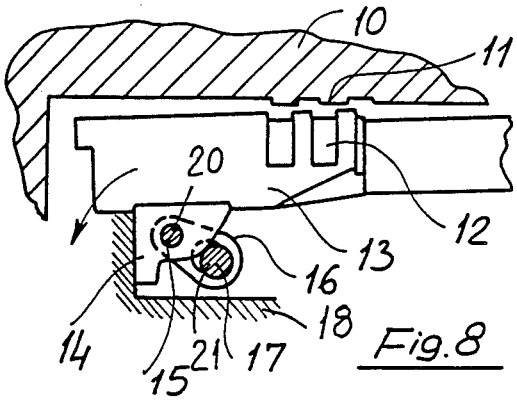
Fig. 8
Fig. 9
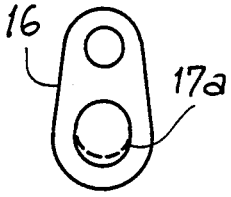
Fig. 10
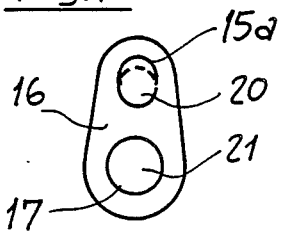
Fig. 11
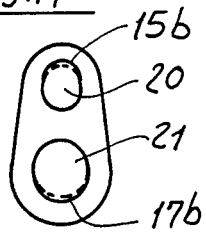
Fig. 12
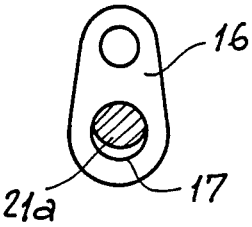
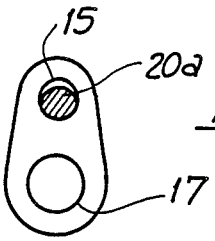
Fig. 13

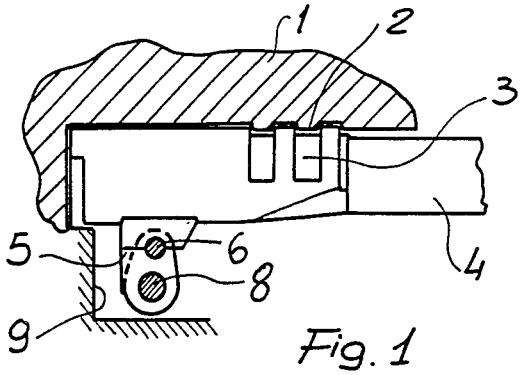
Fig. 1
Fig. 3
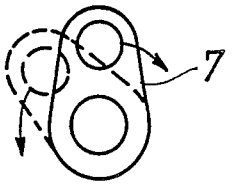
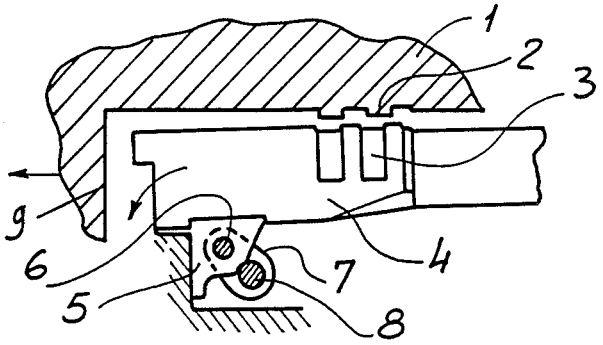
Fig. 2
Fig. 5
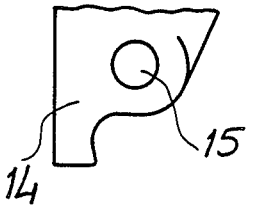
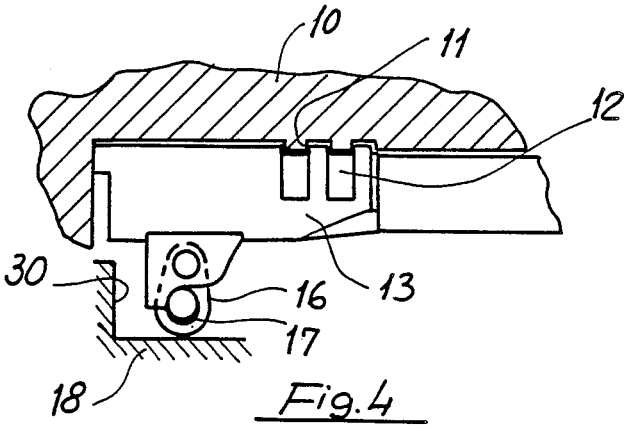
Fig. 4

LOCKING ASSEMBLY FOR WEAPON BARRELS

BACKGROUND OF THE INVENTION

The present invention relates to a locking assembly for weapons, the locking assembly being so designed and arranged as to be disengaged by means of a coupling rod.

As is known, large bore pistols are available, such as the COLT Model 11 pistol, in which, in order to reduce the pressure in the firing chamber and to cause the pistol slide to with a comparatively low speed, after firing, there has been provided a lock up link.

As is clearly shown in FIGS. 1 to 3, the slide 1 is provided with a pair of lugs 2 which are removably engaged in grooves 3 formed in the barrel 4 of the pistol.

The barrel, in turn, is provided, at the bottom thereof, with a lug arm 5 having a top pin 6 thereon there is pivoted a link 7 which, at the other end, is pivoted on a bottom pin 8 rigid with the pistol frame.

Since the slide has usually a weight which is very greater than that of the bullet (conventionally 80 times the bullet weight), the slide and pistol, after firing, start to recoil with a delay with respect to the fired bullet.

As the recoil movement starts, the barrel, because of the articulated link with the coupling 7, starts to recoil and, contemporaneously, it is downward displaced to disengage from the slide and stop as the lug arm 5 abuts against an abutment member 9 of the pistol frame.

Other known locking means provide for recoiling the frame for a length of 3–6 mm, coaxially with respect to the horizontal center line of the barrel.

This embodiment provide a great firing accuracy and a great reduction of the pressure in the firing chamber: however it is rather complex from the construction standpoint.

SUMMARY OF THE INVENTION

Thus, the main object of the present invention is to overcome the above mentioned drawback, by providing a locking assembly for weapons or pistols which can be disengaged by a coupling link and comprises means for longitudinally displacing the barrel thereby improving the firing accuracy, and which is very simple construction-wise.

Another object of the invention is to provide a locking assembly for weapons which is very reliable in operation.

Another object of the invention is to provide such an assembly which can be constructed starting from easily available elements and materials.

According to one aspect of the present invention, the above objects, as well as yet other objects which will become more apparent hereinafter, are achieved by a locking assembly for weapons, suitable to be disengaged by means of a coupling link, comprising a slide including at least a lug to be removably engaged with at least a groove formed in the barrel.

The barrel, in particular, is associated with the weapon frame and the link is coupled to the barrel and weapon frame by members suitable to displace at first the barrel along its longitudinal axis and then rotate said barrel so as to disengage said barrel from the slide.

BRIEF DESCRIPTION OF THE DRAWINGS

Further characteristics and advantages of the invention will become more apparent from the following detailed description of some preferred embodiments of a locking assembly for weapons or pistols which is illustrated, by way of an indicative but not limitative example, in the accompanying drawings, in which:

FIG. 1 schematically shows, by a cross-sectional view, a prior art locking assembly for weapons, in a rest condition;

FIG. 2 shows the prior art assembly of FIG. 1, during the weapon slide recoiling movement;

FIG. 3 schematically shows the swinging movement of a coupling link;

FIG. 4 is a cross-sectional view illustrating the locking assembly according to the invention, in a rest condition;

FIG. 5 is a detail enlarged view illustrating a lug arm coupled to the weapon barrel;

FIG. 6 shows the locking assembly according to the present invention, after a starting barrel translation displacement movement;

FIG. 7 shows the movement of the coupling link, during the starting displacement step;

FIG. 8 is a cross-sectional view illustrating the lock-up rotary movmement of the weapon barrel; and FIGS. 9 and 13 schematically show coupling means of the coupling link suitable to provide a starting translation movement and a subsequent rotary movement of the barrel.

DESCRIPTION OF THE PREFERRED EMBODIMENTS

With reference to FIGS. 4 to 13, the locking assembly for weapons or pistols according to the present invention comprises a slide indicated at the reference number 10, which is provided with a pair of lugs 11, suitable to be removably engaged in corresponding grooves 12 of the barrel 13.

The barrel 13, at the underside thereof, is provided with a lug arm 14, having a pivot hole 15 for a coupling link 16 which, at the other end portion thereof, is provided with a bottom pivot hole 17 for coupling with the weapon frame 18.

The main feature of the invention is that said link 16 is coupled, between the barrel 13 and weapon frame 18, with coupling means suitable to provide at first a translation of the barrel along its longitudinal axis and then a rotary movement of said barrel to disengage it from the weapon slide.

More specifically, the coupling link 16 and pivot pins 20 and 21, respectively, to the lug arm 14 and frame 18, is carried out preferably with a clearance of 1 mm providing a first translation of the barrel of about 3.5 mm.

This clearance may be obtained by several construction methods which are clearly shown in FIGS. 9 to 13.

As shown in FIG. 9, the bottom hole **17*a* has an oval shape so as to provide a clearance of about 1 mm with respect to the pin 21, with a consequent translation or rectilinear displacement movement like that shown in FIG. 7**.

FIG. 10 illustrates a second embodiment in which the top hole **15*a* has an oval shape to provide a clearance of 1 mm with respect to the pin 20**.

FIG. 11 illustrates another embodiment in which the top hole **15*b* and bottom hole 17*b*** are both of oval shape so as to provide in cooperation the desired clearance.

In the embodiment of FIG. 12, the desired clearance is provided by means of a bottom pin **21*a* having an undercut portion so as to form the desired clearance between said undercut portion and the circular bottom hole 17**.

Likewise, in FIG. 13 the desired clearance is formed by a undercut portion on the top pin 20*a*, the top hole 15 having a circular shape.

With the disclosed arrangement, during the starting recoiling displacement of the slide 10, the barrel will be displaced along its longitudinal axis, owing to the clearance of the coupling link.

After this recoiling movement, the link will cause the barrel 13 to rotate and lower so as to stop against the abutment member 30 provided on the weapon frame 18.

While the invention has been disclosed with reference to preferred embodiments thereof, it should be apparent that they are susceptible to many modifications and variations within the spirit of the appended claims.

I claim:

1. A locking assembly for weapons comprising a weapon slide, a weapon barrel and a weapon frame, said barrel having at least a barrel groove, and slide having at least a lug to be removably engaged in said at least a groove of said barrel, a coupling link for removably coupling said barrel to said frame, coupling means for coupling said link to said barrel and frame, said coupling means being suitable to cause said barrel to longitudinally translate at first said barrel and then rotate so as to disengage from said slide, wherein said coupling means comprise a top oval hole at a coupling point of said link and said barrel.

2. A locking assembly according to claim 1, wherein said coupling means comprise a top oval hole and a bottom oval hole at coupling points of said link, said barrel and said frame.

3. A locking assembly according to claim 1, wherein said coupling means comprise a pin having an undercut portion at a coupling point between said frame and a bottom hole of said link.

4. A locking assembly according to claim 1, wherein said coupling means comprise a top pin having an undercut portion at a coupling point between said link and said barrel.

* * * * *